United States Patent [19]

Ishiguro et al.

[11] Patent Number: 4,983,508

[45] Date of Patent: Jan. 8, 1991

[54] METHOD FOR MANUFACTURING A LIGHT-SENSITIVE SILVER HALIDE EMULSION

[75] Inventors: Shoji Ishiguro; Kiyoshi Morimoto, both of Kanagawa, Japan

[73] Assignee: Fuji Photo Film Co., Ltd., Kanagawa, Japan

[21] Appl. No.: 271,987

[22] Filed: Nov. 16, 1988

[30] Foreign Application Priority Data

Nov. 18, 1987 [JP] Japan ..... 62-291487

[51] Int. Cl.[5] ..... G03C 1/15; G03C 1/35

[52] U.S. Cl. ..... 430/569; 430/567

[58] Field of Search ..... 430/569, 567, 597

[56] References Cited

U.S. PATENT DOCUMENTS

| | | | |
|---|---|---|---|
| 3,583,870 | 6/1971 | Gilman | 430/567 |
| 4,399,215 | 8/1983 | Wey | 430/567 |
| 4,801,523 | 1/1989 | Tufano | 430/569 |

*Primary Examiner*—Paul R. Michl

*Assistant Examiner*—Mark R. Buscher

[57] ABSTRACT

A method of producing a silver halide photographic emulsion including the step of:

reacting a water-soluble silver salt and at least one water-soluble halide salt containing chloride in aqueous solution in the presence of at least one compound represented by formulae (I) or (II):

(I)

(II)

wherein $A_1$, $A_2$, $A_3$ and $A_4$, which may be the same or different, each represents a nonmetallic atomic group necessary for forming a substituted or unsubstituted heterocyclic ring; B represents a divalent linking group; $R_1$ and $R_2$, which may be the same or different, each represents an alkyl group; X represents an anion necessary for charge balance; m is 0 or 1; and n is 0 or 1;

to form light-sensitive silver halide grains having a silver chloride content of at least 50 mol %, selected from octahedral grains, tetradecahedral grains and tablular grains, wherein at least 30% of the surface area of said light-sensitive silver halide grains is composed of (111) planes. The high chloride silver halide emulsions are suitable for rapid development processing with reduced fogging.

18 Claims, 1 Drawing Sheet

METHOD FOR MANUFACTURING A LIGHT-SENSITIVE SILVER HALIDE EMULSION

FIELD OF THE INVENTION

This invention concerns a method for the manufacture of light-sensitive silver halide emulsions for photographic purposes. More precisely, the invention concerns a method for the manufacture of silver halide emulsions for photographic purposes which contain silver chloride, or silver chlorobromide, silver chloroiodide or silver chloroiodobromide which has a high silver chloride content, in a tabular, octahedral or tetradecahedral grain which has a (111) plane.

BACKGROUND OF THE INVENTION

A shortening of processing time is greatly desired in the photographic industry today and there is an urgent need for the development of silver halide photographic materials which are suitable for rapid processing.

The water solubility of silver halide is increased when the silver chloride content is increased and shorter developing and fixing times can be achieved, and silver halides which are suitable for rapid processing have been obtained in this way.

Silver halide grains which have a high silver chloride content (referred to herein as "high silver chloride grains") generally have a cubic form consisting of (100) planes, and it is desired to obtain grains which have a form other than a cubic form, such as a tabular form or a regular crystalline form, i.e., an octahedral or tetradecahedral form, which has (111) planes.

It is well known to those in the industry that tabular grains in which the diameter is considerably larger than the thickness are preferred for raising the speed of a silver halide emulsion for photographic purposes, increasing sharpness, and improving graininess, color sensitizing efficiency with sensitizing dyes and covering power. The only known tabular grains which have a high silver chloride content in excess of 50 mol % and which do not contain bromide or iodide inside are those formed by the method of U.S. Pat. No. 4,399,215 in which the grains are formed at a pAg within the range from 6.5 to 10 and a pH maintained within the range from 8 to 10 using ammonia; those formed by the method of U.S. Pat. No. 4,400,463 in which grain formation is carried out in the presence of aminoazaindene and a peptizer which has thioether bonds; and those formed by the method of JP-A-62-218959 in which thiourea based compounds are used (the term "JP-A" as used herein refers to a "published unexamined Japanese patent application").

However, with the method in which ammonia is used it is difficult to form emulsions generally used for light-sensitive materials for rapid processing in which the volume of the grains is comparatively small (i.e., not more than 1 $\mu m^3$) in order to further increase the solubility of the highly soluble high silver chloride content grains. Further, because of the inevitably high pH during the formation of the grains, increased fogging often occurs with sensitive high silver chloride content emulsions. Therefore, the conditions under which the grains can be formed by using this method are greatly restricted.

The peptizers in the methods in which peptizers which have thioether bonds are used are synthetic polymers. It is difficult to obtain copolymers with good reproducibility, the polymerization initiator may contain impurities which are harmful photographically, and there is a further disadvantage in that the desalting process may be complicated. Furthermore, it is costly to eliminate these difficulties and this is disadvantageous from the industrial point of view.

On the basis of the facts outlined above it is clear that the development of a method for obtaining high silver chloride content tabular grains with good reproducibility in the acid-neutral region using cheap, low molecular weight compounds which are easily synthesized and refined, either alone or in conjunction with gelatin which is the normally used as a general purpose peptizer, is clearly desirable.

The above-mentioned tabular grains are grains which have twinned crystal planes within the grain and in which the outer surfaces (i.e., basal planes) are (111) planes, and few methods are known for the preparation of high silver chloride content grains which have no twinned crystal planes and which are regular crystals, consisting of octahedra or tetradecahedra which have (111) planes as outer surfaces.

Such methods include those described by Claeo et al., *The Journal of Photographic Science,* Volume 21, 39 (1973) and Wyrsch, *International Congress of Photographic Science* III-13, 122 (1978).

The compounds dimethyl thiourea, thiourea and adenine are used by Claeo et al. but the photographic properties of the octahedral grains obtained are not fully reported. Moreover, when considered from the point of view of the compound structure it can be concluded that they are compounds which, like adenine, are quite strongly adsorbed on silver halides and compounds which have unstable sulfur atoms which readily give rise to fogging.

In Wyrsch, ammonia and a large amount of cadmium nitrate are used, octahedral silver chloride grains are obtained and a photographic performance similar to that of cubic grains is obtained, but cadmium is undesirable for use in practice from the point of view of pollution. Furthermore, high silver chloride content grains are easily fogged, so the use of ammonia is undesirable, and the preparation of high silver chloride content octahedral grains without the use of ammonia and without pollution problems is desirable.

Thus, as described above, the development of a novel method for the preparation of regular crystalline grains, which is to say tetradecahedral or octahedral grains, or tabular grains which have twinned crystal planes within the grains, with fresh and stable (111) planes on the outer surface is clearly desirable.

SUMMARY OF THE INVENTION

An object of the present invention is to provide a method for the manufacture of silver halide emulsions which have a high silver chloride content and (111) planes on the outer surface, and which can be developed and processed very quickly and which are suitable for rapid development processing.

Another object of the invention is to provide a method for the manufacture of tabular silver halide emulsions which have a high silver chloride content using compounds which are easily prepared and which are inexpensive.

A further object of the invention is to provide a method for the manufacture of high silver chloride content emulsions which have many regular tetradecahedral or octahedral crystal grains with (111)

planes under acid conditions in which the occurrence of fogging is suppressed, and without giving rise to pollution.

As a result of thorough research, the inventors have discovered that these and other objects of the invention can be realized by a method for producing a silver halide photographic emulsion including the step of:

reacting a water-soluble silver salt and at least one water-soluble halide salt containing chloride in aqueous solution in the presence of at least one compound represented by formulae (I) or (II):

(I)

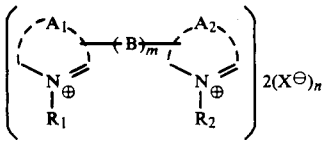

(II)

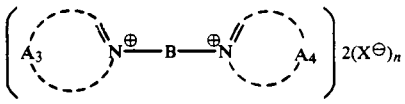

wherein $A_1$, $A_2$, $A_3$ and $A_4$, which may be the same or different, each represents a nonmetallic atomic group necessary for forming a substituted or unsubstituted heterocyclic ring; B represents a divalent linking group; $R_1$ and $R_2$, which may be the same or different, each represents an alkyl group; X represents an anion necessary for charge balance; m is 0 or 1; and n is 0 or 1;

to form light-sensitive silver halide grains having a silver chloride content of at least 50 mol %, selected from octahedral grains, tetradecahedral grains and tabular grains, wherein at least 30% of the surface area of said light-sensitive silver halide grains is composed of (111) planes.

Figure 1:
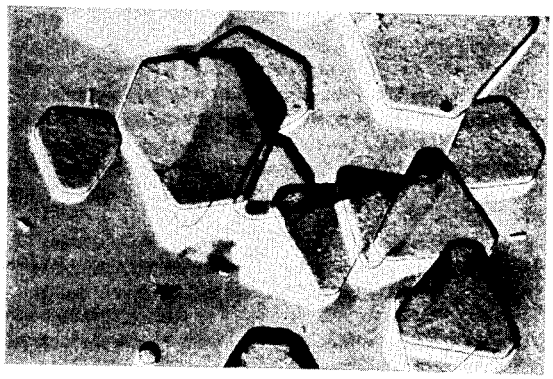
FIGS. 1 and 2 are electron micrographs which show the structures of the silver halide crystal grains in Emulsion D of Example 1 and Emulsion I of Example 2, respectively.

The magnification in each case is 12,500 times.

DETAILED DESCRIPTION OF THE INVENTION

General formulae (I) and (II) are described in more detail below.

$A_1$, $A_2$, $A_3$ and $A_4$ each represents a group of nonmetallic atoms which are required to complete a nitrogen-containing heterocyclic ring, and they may include oxygen atoms, nitrogen atoms and sulfur atoms and they may be condensed with a benzene ring. The heterocyclic rings formed by $A_1$, $A_2$, $A_3$ and $A_4$ may have substituent groups, and they may be the same or they may be different. Specific examples of the substituent groups include substituted or unsubstituted alkyl, aryl, aralkyl, alkenyl, acyl, alkoxycarbonyl, aryloxycarbonyl, alkoxy, aryloxy, arylthio, or alkylthio groups or halogen atoms, acyl groups, sulfo groups, carboxy groups, hydroxy groups, amido groups, sulfamoyl groups, carbamoyl groups, ureido groups, amino groups, sulfonyl groups, cyano groups, nitro groups or mercapto groups. Preferred examples of the substituent groups are substituted or unsubstituted alkyl groups having from 4 to 10 carbon atoms. Substituted or unsubstituted aryl-substituted alkyl groups are more preferred substituent groups. Preferably, $A_1$, $A_2$, $A_3$ and $A_4$ form 5- or 6-membered rings (for example, pyridine rings, imidazole rings, thiazole rings, oxazole rings, pyrazine rings, and pyrimidine rings) and more preferably they form pyridine rings.

B represents a divalent linking group. The divalent linking group may be an alkylene group (preferably having 1 to 10 carbon atoms, such as ethylene, propylene and pentalene), an arylene group (preferably having 6 to 12 carbon atoms, such as phenylene and naphthalene), an alkenylene group (preferably having 2 to 10 carbon atoms, such as vinylene and butenylene), $-SO_2-$, -SO-, -O-, -S-,

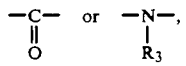

or a combination of these groups (where $R_3$ represents an alkyl group, an aryl group or a hydrogen atom). Preferably B is an alkylene group or an alkenylene group.

$R_1$ and $R_2$ represent alkyl groups which have at least 1, but not more than 20, carbon atoms. $R_1$ and $R_2$ may be the same or different.

The alkyl groups may be substituted or unsubstituted alkyl groups and the substituent groups are the same as those indicated as substituent groups for $A_1$, $A_2$, $A_3$ and $A_4$.

Preferably $R_1$ and $R_2$ each represents an alkyl group which has from 4 to 10 carbon atoms, and more preferably they represent alkyl groups substituted with substituted or unsubstituted aryl groups.

X represents an anion required for charge balance, including, for example, a chloride ion, a bromide ion, an iodide ion, a nitrate ion, a sulfate ion, a p-toluenesulfonateion ad an oxalate ion. n is 0 or 1, and n is 0 when an inner salt is formed.

Specific examples of compounds represented by formula (I) or formula (II) are indicated below, but the invention is not to be construed as being limited to these compounds.

(1)

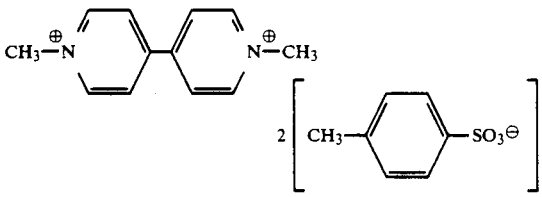

-continued
(2)
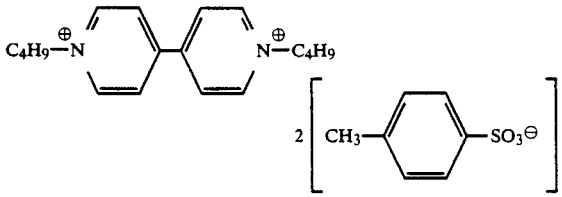
(3)
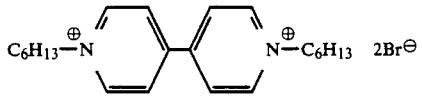
(4)
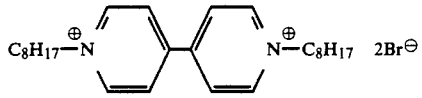
(5)
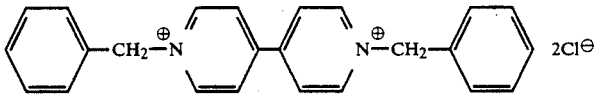
(6)
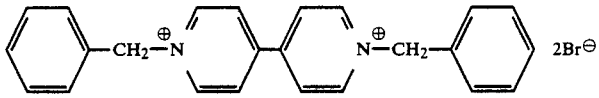
(7)
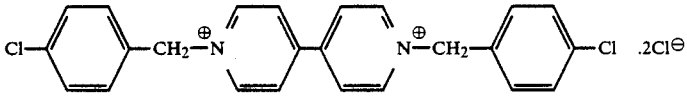
(8)
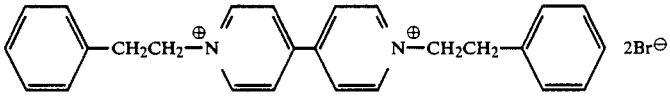
(9)
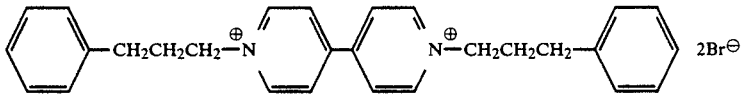
(10)
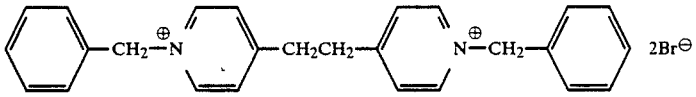
(11)
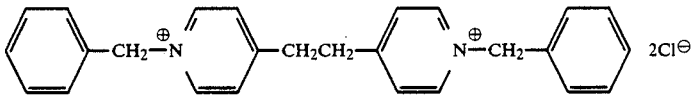
(12)
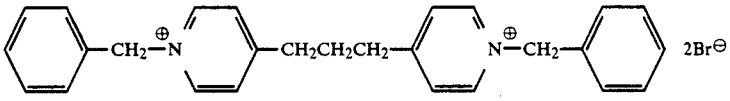
(13)
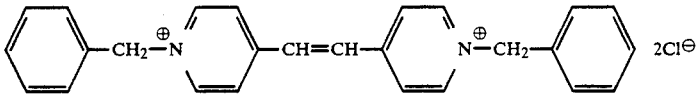

-continued
(14)
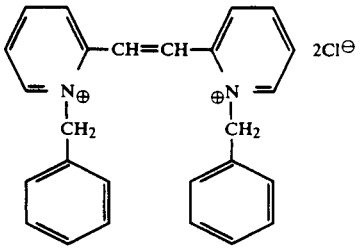
(15)
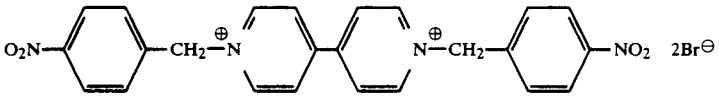
(16)
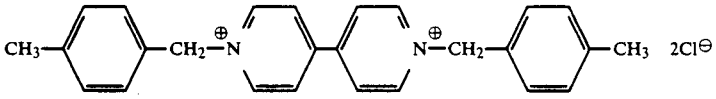
(17)
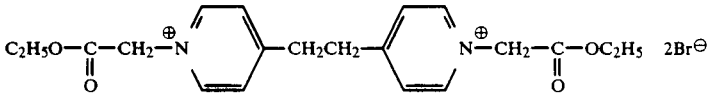
(18)
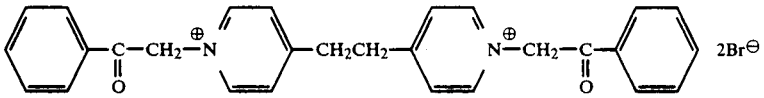
(19)
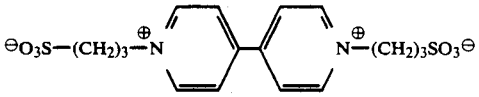
(20)
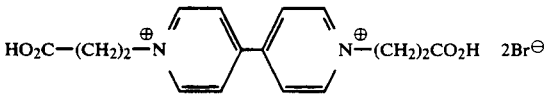
(21)
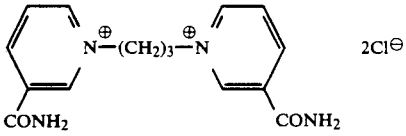
(22)
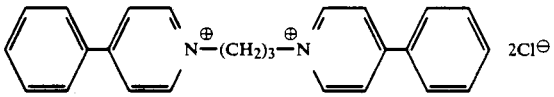
(23)
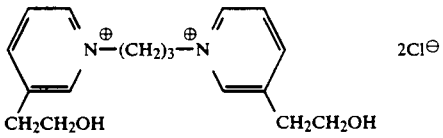
(24)
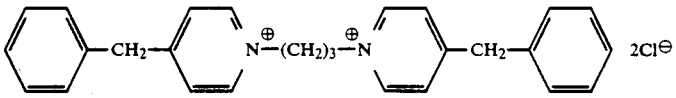
(25)
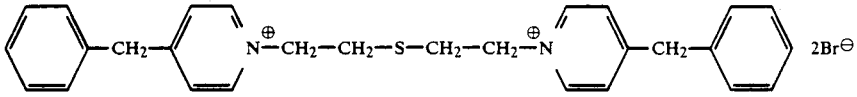

-continued
(26)
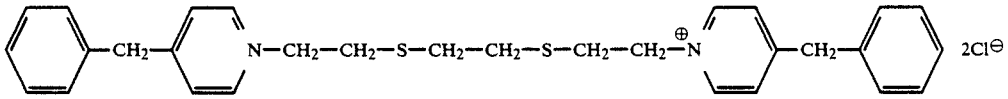
(27)
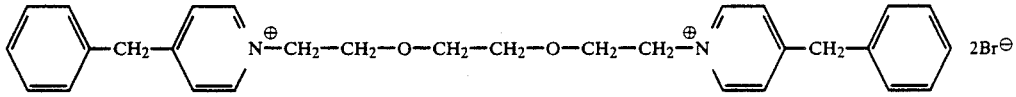
(28)
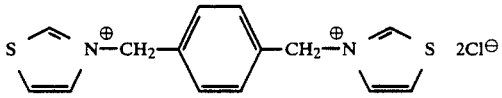
(29)
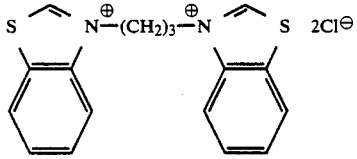
(30)
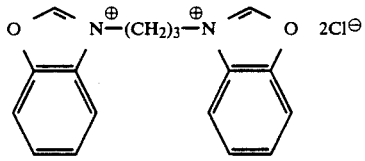
(31)
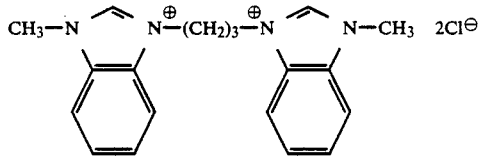
(32)
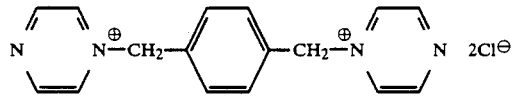
(33)
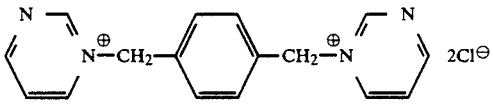
(34)
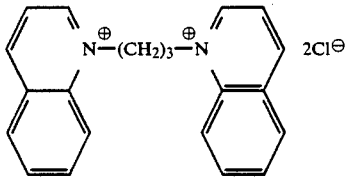
(35)
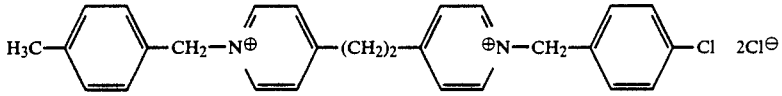
(36)
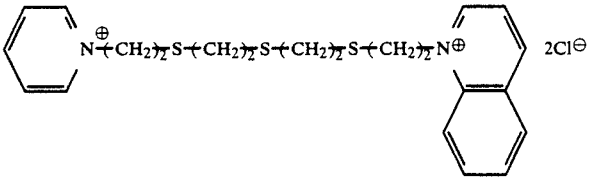

-continued (37)

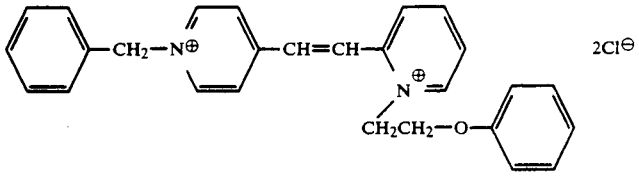

(38)

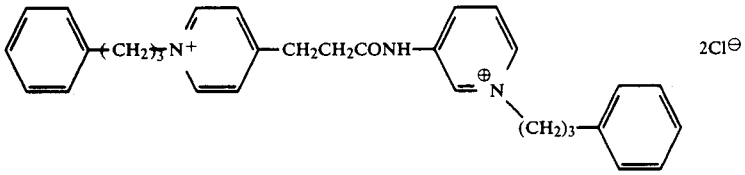

(39)

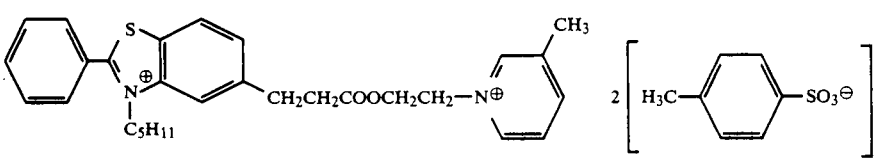

(40)

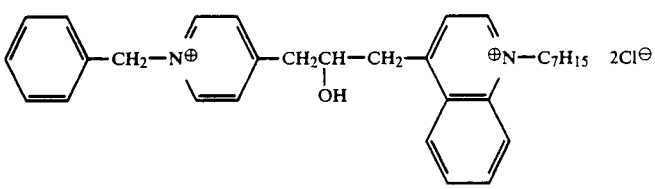

(41)

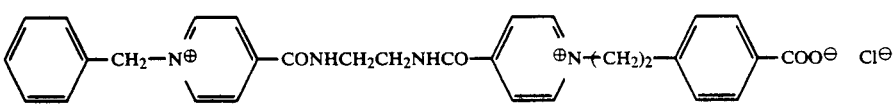

(42)

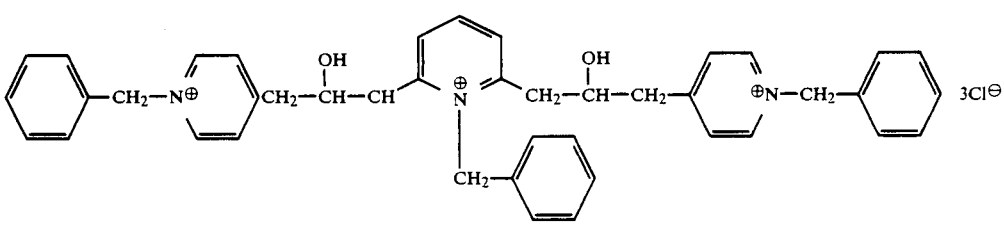

Methods for the Svnthesis of these Compounds

The compounds represented by formulae (I) and (II) can easily be synthesized by methods known in the art. Two illustrative synthesis examples for these compounds are as follows.

Synthesis of Compound (6)

Benzyl bromide (190 ml) was added to 100 g of 4,4'-bipyridine in 800 ml of methanol and the mixture was heated under reflux for 3 hours. The reaction mixture was then filtered, 800 ml of isopropyl alcohol was added, and the crystals which formed were recovered by filtration to provide compound (6). Yield: 286 g (90%)

Synthesis of Compound (12)

Benzyl bromide (30 ml) was added to 20 g of 1,3-di-4-pyridylpropane in 400 ml of ethanol and the mixture was heated under reflux for 2 hours. The reaction mixture was then filtered, 400 ml of ethyl acetate was added and the crystals obtained were recovered by filtration to provide compound (12). Yield: 41 g (76%)

The amounts of the compounds represented by general formula (I) or general formula (II) of the present invention which are added are within the range from $2\times10^{-5}$ mol to $3\times10^{-1}$ mol per mol of silver halide contained in the emulsion formed, and preferably from $2\times10^{-4}$ to $1\times10^{-1}$ mol per mol of silver halide contained in the emulsion formed.

The compounds of this invention are added at a stage such that they are present at some point during the formation of the grains between the time at which the nuclei of the silver halide grains are formed and the completion of physical ripening during the manufacturing process of the silver halide emulsion. However, when manufacturing tabular grains the compounds are preferably present from the start of grain formation.

The formation of regular crystalline (octahedral - tetradecahedral) grains and tabular grains using compounds of this invention can be achieved by controlling the chloride concentration of the grains which are formed in the initial stage (during the formation of the nuclei) and/or by selecting the time at which the compound of the invention is added. In practice, there are slight differences depending on the type of compound and the amount added, but in general terms the conditions are as follows:

(1) For the Preparation of Tabular Grains

To an aqueous solution containing chloride and gelatin, a compound of the present invention is added and then silver nitrate and chloride are added thereto. Thus, silver chloride grain nuclei are formed.

The concentration of chloride when a compound of this invention is present at the time at which the nuclei are being formed is between 0.05 and 5 mol/liter, preferably between 0.07 and 2 mol/liter, and most desirably between 0.15 and 0.5 mol/liter. After the formation of silver chloride grain nuclei, a compound of this invention is further added to the solution for the grain growth. When a compound of this invention is present during the growth of the grains the chloride concentration is not more than 5 mol/liter, and preferably between 0.1 and 2 mol/liter.

(2) For the Preparation of Regular Crystalline Grains

To an aqueous solution containing chloride and gelatin, a compound of the present invention is added and then silver nitrate and chloride are added thereto. Thus, silver chloride grain nuclei are formed.

The concentration of chloride when a compound of this invention is present at the time at which the nuclei are being formed is not more than 0.5 mol/liter, preferably between 0.02 and 0.2 mol/liter, and most desirably between 0.05 and 0.1 mol/liter. After the formation of silver chloride grain nuclei, a compound of this invention is further added to the solution for the grain growth. When a compound of this invention is present during the growth of the grains the concentration of chloride is not more than 5 mol/liter, and preferably between 0.07 and 2.0 mol/liter.

In this invention, the temperature during the formation of the grains can be within the range from 10° C. to 95° C, and it is preferably within the range from 40° C. to 90° C.

The system may have any pH value, but a pH in the range of from 2 to 8 is preferred.

The high silver chloride content grains of this invention are grains which have a silver chloride content of at least 50 mol %. The grains preferably have a silver chloride content of at least 70 mol % and those which have a silver chloride content of at least 90 mol % are especially desirable.

The remainder of the grains may consist of silver bromide and/or silver iodide, but a silver iodide content of not more than 20 mol %, and preferably of not more than 10 mol %, is desirable. The presence of a local layer consisting principally of silver bromide or silver iodide in the vicinity of the surface of the grains is especially desirable.

Furthermore, the grains may be core/shell type grains, and in such a case the silver chloride content of the core is preferably higher than that of the shell. For example, the grains may have a structure in which the core consists of silver chloride and the shell consists of silver bromide.

The silver halide grains of this invention have surfaces consisting of (111) planes, and at least 30% of the whole surface, preferably at least 40% of the whole surface, and most desirably at least 60% of the whole surface, consists of (111) planes. The estimation of the area of (111) planes can be achieved from electron micrographs of the silver halide grains which have been formed.

No particular limitation is imposed upon the average grain size in the case of the regular crystal type silver halide grains of this invention, but the size is generally from 0.1 to 5 μm, and preferably from 0.2 to 3 μm.

When the silver halide grains of this invention have a tabular form, the diameter/thickness ratio is preferably at least 2, more desirably at least 2 but not more than 50, even more desirably at least 2 and not more than 20, and most desirably at least 3 and not more than 10.

Herein, the term "diameter of a silver halide grain" means the diameter of a circle which has the same area as the projected area of the grain. In this invention, the diameter of a tabular silver halide grain is generally from 0.3 to 5 0 μm, and preferably from 0.3 to 3.0 μm.

The thickness is not more than 0.4 μm, preferably not more than 0.3 μm, and most desirably not more than 0.2 μm. The average volume of the volume load of the grains is preferably not more than 2 $\mu m^3$. A value of not more than 1.0 $\mu m^3$ is especially desirable.

In general, the tabular silver halide grains have a tabular form with two parallel planes, and in this invention the term "thickness" signifies the distance between the two parallel planes with which the tabular silver halide grain is formed.

The grain size distribution of the silver halide grains of this invention may be polydisperse or monodisperse, but monodispersions are preferred.

The silver halide emulsions of this invention may be internal latent image type emulsions or surface latent image type emulsions.

Silver halide solvents may be used during the manufacture of silver halide grains of this invention.

Silver halide solvents which can be used include thiocyanates (for example, U.S. Pat. Nos. 2,222,264, 2,448,534 and 3,320,069), thioether compounds (for example, U.S. Pat. Nos. 3,271,157, 3,574,628, 3,704,130, 4,297,439 and 4,276,347), thione compounds and thiourea compounds for example, JP-A-53-144319, JP-A-53-82408, JP-A-55-7773), amine compounds (for example, JP-A-54-100717). Furthermore, ammonia can also be used within the range where it has no adverse effect.

Cadmium salts, zinc salts, lead salts, thallium salts, iridium salts or complex salts thereof, rhodium salts or complex salts thereof, iron salts or complex salts thereof may also be present during the formation or physical ripening process of the silver halide grains. The presence of iridium salts or rhodium salts is especially desirable.

The use of methods in which the rate of addition of the silver salt solution (for example, an aqueous silver nitrate solution) and the halide solution (for example, an aqueous sodium chloride solution) which are being added, the amounts being added, and the addition concentrations, are increased with the passage of time during the addition in order to speed up grain growth is preferred for the manufacture of silver halide grains of this invention. Suitable methods are described, for example, in British Patent No. 1,335,925, U.S. Pat. Nos. 3,672,900, 3,650,757 and 4,242,445, and in JP-A-55-142329, JP-A-55-158124, JP-A-58-113927, JP-A-58-113928, JP-A-58-111934 and JP-A-58-111936.

The tabular silver halide grains of this invention can be used as they are without chemical sensitization or they can be chemically sensitized, as required.

Chemical sensitization methods such as sensitization with gold compounds (for example, U.S. Pat. Nos. 2,448,060 and 3,320,069); sensitization with metals such as iridium, platinum, rhodium, palladium (for example, U.S. Pat. Nos. 2,448,060, 2,566,245 and 2,566,263); sulfur sensitization methods in which sulfur containing compounds are used (for example, U.S. Pat. No. 2,222,264); selenium sensitization methods in which selenium compounds are used; reduction sensitization methods with thiourea dioxide or polyamines (for example, U.S. Pat. Nos. 2,487,850, 2,518,698 and 2,521,925); or combinations of two or more of these methods, can be used for this purpose.

The use of gold sensitization, sulfur sensitization or the joint use of gold and sulfur sensitization is preferred with silver halide grains of this invention.

Conventionally known silver halide grains can also be present as well as the silver halide grains of this invention in the emulsion layers of silver halide photographic materials produced using this invention.

In photographic emulsions which contain high silver chloride content grains of this invention, the high silver chloride content grains are preferably included in such an amount equal to at least 50%, preferably at least 70%, and most desirably at least 90%, of the projected area of all of the silver halide grains in the emulsion.

When photographic emulsions of this invention are used in the form of a mixture with other photographic emulsions the high silver chloride content grains of this invention are preferably included in an amount equal to at least 50% of the grains in the emulsion after mixing.

Moreover, when photographic emulsions of this invention are used in the form of a mixture with other photographic emulsions, then the mixed emulsion is preferably a high silver chloride content emulsion which contains at least 50 mol % of silver chloride.

The emulsions of this invention may be chemically sensitized using methine dyes and other dyes. The dyes which can be used include cyanine dyes, merocyanine dyes, complex cyanine dyes, complex merocyanine dyes, holopolar cyanine dyes, hemicyanine dyes, styryl dyes, and hemioxonol dyes. The dyes classified as cyanine dyes, merocyanine dyes and complex merocyanine dyes are especially useful for this purpose. Any of the nuclei normally used in cyanine dyes can be used as the basic heterocyclic nuclei in these dyes, including the pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; nuclei in which these nuclei are fused to an aliphatic hydrocarbon ring, and nuclei in which these nuclei are fused with an aromatic hydrocarbon ring, e.g., the indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, and quinoline nucleus. These nuclei may also be substituted on the carbon atoms.

The 5- and 6-membered heterocyclic nuclei, such as the pyrazolin-5-one nucleus, thiohydantoin nucleus, 2-thiooxazolidin-2,4-dione nucleus, thiazolidin-2,4-dione nucleus, rhodanine nucleus, and thiobarbituric acid nucleus can be used as the nuclei which have a ketomethylene structure in the merocyanine dyes or complex merocyanine dyes.

The compounds disclosed in *Research Disclosure,* Item 17643, page 23, paragraph IV (December, 1978) and the compounds disclosed in the publications cited therein can be used, for example, for this purpose.

The dye may be added to the emulsion at any stage during the preparation of the emulsion at which it is known conventionally to be useful. It is normally added after completion of chemical sensitization an prior to coating, but the dye may be added at the same time as the chemical sensitizing agents and spectral sensitization can be carried out at the same time as chemical sensitization, as disclosed in U.S. Pat. Nos. 3,628,969 and 4,225,666; or spectral sensitization can be carried out before chemical sensitization, as disclosed in JP-A-58-113928; or spectral sensitization can be started before the completion of the precipitation and formation of the silver halide grains. Moreover, the aforementioned compounds can be divided and added in separate lots, as indicated in U.S. Pat. No. 4,225,666, which is to say that some of the compound can be added prior to chemical sensitization and the remainder can be added after chemical sensitization. Moreover, the addition can be made at any stage during the formation of the silver halide grains, as indicated primarily in the method disclosed in U.S. Pat. No. 4,183,756.

The amount added can be from $4\times10^{-6}$ to $8\times10^{-3}$ mol per mol of silver halide, but at the preferred silver halide grain size of from 0.2 to 3 $\mu$m, the addition of an amount within the range from about $5\times10^{-5}$ to about $2\times10^{-3}$ mol per mol of silver halide is most effective.

Silver halide emulsions prepared in accordance with this invention can be used in either color photographic materials or black-and-white photographic materials.

Examples of color photographic materials include color papers, films for color photography, color reversal films, and examples of black-and-white materials include X-ray films, films for general photography, films for printing sensitive materials, but the use of the emulsions in color papers is especially advantageous.

No particular limitation exists in connection with other additives for the photographic materials in which emulsions of this invention are used, and those disclosed in *Research Disclosure,* Volume 176, Item 17643 (RD 17643) and *Research Disclosure,* Volume 187, Item 18716 (RD 18716) can be used.

The disclosure relating to various additives in RD 17643 and RD 18716 is summarized below.

| Type of Additive | RD 17643 | RD 18716 |
|---|---|---|
| 1. Chemical sensitizers | Page 23 | Page 648, right column |
| 2. Sensitivity increasing agents | | Page 648, right column |
| 3. Spectral sensitizers, Supersensitizers | Pages 23–24 | Page 648, right column to page 649, right column |
| 4. Whiteners | Page 24 | |
| 5. Antifoggants and Stabilizers | Pages 24–25 | Page 649, right column |
| 6. Light absorbers, Filter Dyes, UV Absorbers | Pages 25–26 | Page 649, right column to page 650, left column |
| 7. Antistaining agents | Page 25, right column | Page 650, left to right columns |
| 8. Dye image stabilizers | Page 25 | |
| 9. Film hardening agents | Page 26 | Page 651, left column |
| 10. Binders | Page 26 | Page 651, left column |
| 11. Plasticizers, Lubricants | Page 27 | Page 650 right column |
| 12. Coating aids, Surfactants | Pages 26–27 | Page 650 right column |

-continued

| Type of Additive | RD 17643 | RD 18716 |
|---|---|---|
| 13. Antistatic agents | Page 27 | Page 650 right column |

Among the aforementioned additives, azoles (for example, benzothiazolium salts, nitroindazoles, nitrobenzimidazoles, chlorobenzimidazoles, bromobenzimidazoles, nitroimidazoles, benzotriazoles, aminotriazoles); mercapto compounds (for example, mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines); thioketone compounds such as oxazolinethione; azaindenes (for example, triazaindenes, tetraazaindenes (especially 4-hydroxy substituted (1,3,3a,7)tetraazaindenes), pentaazaindenes); benzenethiosulfonic acid; benzenesulfinic acid, benzenesulfonic acid amide are preferably used as antifogging agents and stabilizers.

The use of color couplers which have hydrophobic groups, known as ballast groups, within the molecule and polymerized color couplers for the color couplers is preferred. The couplers may be 2-equivalent or 4-equivalent with respect to silver ion. Furthermore, colored couplers which have a color correcting effect or couplers which release a development inhibitor during development (DIR couplers) can also be included. Furthermore, colorless DIR coupling compounds which release a development inhibitor and of which the products of the coupling reaction are colorless can also be included. For example, the 5-pyrazolone couplers, pyrazolobenzimidazole couplers, pyrazolotriazole couplers, pyrazolotetrazole couplers, cyanoacetylcoumarone couplers, and open chain acylacetonitrile couplers are available as magenta couplers; the acylacetamide couplers (for example, the benzoylacetanilides and pivaloylacetanilides) are available as yellow couplers; and the naphthol couplers and phenol couplers are available as cyan couplers. The use of naphthol based couplers in which a sulfonamido group or amido group is substituted at the 5-position of naphthol ring, phenol based couplers which have an acylamino group in the 5-position and a phenylureido group in the 2-position, 2,5-diacylamino substituted phenol based couplers, and phenol based couplers which have an ethyl group in the meta position of the phenol ring disclosed in U.S. Pat. Nos. 3,772,002, 2,772,162, 3,758,308, 4,126,396, 4,334,011, 4,327,173, 3,446,622, 4,333,999, 4,451,559 and 4,427,767 are preferred cyan couplers in view of the excellent fastness of the colored image.

Two or more of the above-mentioned couplers can be used together in the same layer in order to provide the characteristics required in the photosensitive material, and the same compound can be added to two or more different layers.

Hydroquinones, 5-hydroxycoumarones, 6-hydroxychromans, p-alkoxyphenols, hindered phenols represented by bisphenols, gallic acid derivatives, methylenedioxybenzenes, aminophenols, hindered amines, and ether and ester derivatives of these compounds in which a phenolic hydroxyl group has been silylated or alkylated are typical examples of anti-color fading agents. Furthermore, metal complexes typified by (bis-salicylaldoxymato)nickel complex and (bis-N,N-dialkyldithiocarbamato)nickel complex can also be used for this purpose.

Any known methods can be employed for the photographic processinq of photosensitive materials to which the invention has been applied, and known processing solutions can be used. Furthermore, a processing temperature can be selected between 18° C. and 50° C, but temperatures below 18° C. and temperatures above 50° C. can also be used. Either a development process for forminq a silver image (black-and-white photographic processing) or color photographic processing with development for forming a dye image can be used, depending on the intended purpose.

Known developing agents such as dihydroxybenzene (for example hydroquinone) 3-pyrazolidones (for example 1-phenyl-3-pyrazolidone), aminophenols (for example, N-methyl-p-aminophenol) can be used either individually or in combination in black-and-white development solutions.

A color development solution generally consists of an alkaline aqueous solution which contains a color developing agent. Known primary aromatic amine developing agents, for example, the phenylenediamines (for example, 4-amino-N,N-diethylaniline, 3-methyl-4-amino-N,N-diethylaniline, 4-amino-N-ethyl-N-β-hydroxy-ethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline) can be used as the color developing agent.

The developing agents disclosed by L. F. A. Mason on pages 226–229 of *Photographic Processing Chemistry* (Focal Press, 1966), in U.S. Pat. Nos. 2,193,015 and 2,592,364, and in JP-A-48-64933 can also be used.

The development solution may also contain pH buffers such as the sulfites, carbonates, borates and phosphates of the alkali metals, development inhibitors and antifogging agents such as bromides, iodides and organic antifogging agents. Furthermore, hard water softening agents, preservatives such as hydroxylamine, organic solvents such as benzyl alcohol and diethylene glycol, development accelerators such as polyethylene glycol, quaternary ammonium salts and amines, dye forming couplers, competitive couplers, fogging agents such as sodium borohydride, auxiliary developing agents such as 1-phenyl-3-pyrazolidone, viscosity imparting agents, polycarboxylic acid based chelating agents as disclosed in U.S. Pat. No. 4,083,723, and antioxidants as disclosed in West German Patent Application (OLS) No. 2,622,950 can also be included, as required.

The photographic material is normally subjected to a bleaching process after color development in cases where color photographic processing is carried out. The bleaching process may be carried out at the same time as the fixing process or it may be carried out as a separate process. Compounds of polyvalent metals such as iron(III), cobalt(III), chromium(IV), copper(II); peracids; quinones; and nitroso compounds can be used as bleaching agents. For example, ferricyanides, dichromates, organic complex salts of iron(III) or cobalt(III), for example, complexes with aminopolycarboxylic acids, such as ethylenediaminetetraacetic acid and 1,3-diamino-2-propanoltetraacetic acid, citric acid, tartaric acid or malic acid, persulfates, permanganates, and nitrosophenol can be used for this purpose. Of these bleaching agents potassium ferricyanide ethylenedimaminteleraacetic acid iron(III) sodium salt and ethylenediaminetetraacetic acid iron(III) ammonium salt are especially useful. Ethylenediaminetetraacetic acid iron(III) complex salts are useful in both independent bleach solutions and in single bleach-fix solutions.

The bleaching accelerators disclosed in U.S. Pat. Nos. 3,042,520 and 3,241,966, and in JP-B-45-8506 and JP-B-45-8836 (the term "JP-B" as used herein refers to an "examined Japanese patent publication"), the thiol compounds disclosed in JP-A-53-65732, and various other additives can be added to the bleach or bleach-fix solutions. Furthermore, after bleaching or bleach fixing the material can be subjected to a water washing process or it may be subjected to a stabilization bath treatment alone.

The invention is now described in greater detail with reference to specific examples, but the invention is not to be construed as being limited to these examples. Unless otherwise indicated, all parts, percents and ratios are by weight.

EXAMPLE 1

Preparation of Silver Chloride Emulsions

Silver halide emulsions were prepared in the following way:

| | |
|---|---|
| Solution (1) | |
| Inert gelatin | 30 g |
| NaCl | (a) g (see Table 1) |
| $H_2O$ | 1,000 cc |
| Solution (2) | |
| $AgNO_3$ | 10 g |
| Water to make up to | 200 cc |
| Solution (3) | |
| NaCl | (b) g (see Table 1) |
| Water to make up to | 200 cc |
| Solution (4) | |
| $AgNO_3$ | 90 g |
| Water to make up to | 600 cc |
| Solution (5) | |
| NaCl | 42 g |
| Water to make up to | 600 cc |

Solution (1) which was maintained at 50° C. was stirred vigorously and the compounds of this invention as shown in Table 1 were added, after which Solutions (2) and (3) were added at the same time over a period of 3 minutes.

Moreover, Solutions (4) and (5) were then added at the same time over a period of 20 minutes and a silver chloride emulsion was obtained.

A comparative emulsion (Emulsion A) prepared without the addition of compounds included in the invention had a cubic form, but the emulsions (Emulsions B to H) to which compounds included in the invention were added contained grains which had a comparatively octahedral or tetradecahedral form when the amount of NaCl (a) was small and grains which had a tabular form when the amount of NaCl (a) was large, as shown in Table 1.

TABLE 1

| Emulsion | Amount of NaCl (a) (g) | Amount of NaCl (b) (g) | Compound of the Invention No. | Compound of the Invention Amount (g) | Form of the Silver Halide Obtained |
|---|---|---|---|---|---|
| A | 11 | 4.5 | — | — | Cubic |
| B | 11 | 4.5 | 11 | 0.5 | Tabular grains |
| C | 5 | 3.0 | 11 | 0.5 | Octahedral grains and tabular grains |
| D | 11 | 4.5 | 5 | 0.3 | Tabular grains (FIG. 1) |
| E | 5 | 3.0 | 5 | 0.3 | Octahedral grains and tabular grains |
| F | 11 | 4.5 | 7 | 0.3 | Octahedral grains and tabular grains |
| G | 11 | 4.5 | 8 | 0.3 | Octahedral grains and tabular grains |
| H | 11 | 4.5 | 12 | 0.3 | Tabular grains and octahedral grains |

EXAMPLE 2

Silver chloride emulsions were prepared in the same way as Emulsion A in Example 1 except that the compounds included in the invention were added after the addition of Solutions (2) and (3) during the preparation of Emulsion A in Example 1.

Although Emulsion A which was prepared without the addition of compounds of this invention had grains which had a cubic form, Emulsions I and J to which compounds included in the invention were added had grains which had octahedral and tetradecahedral forms.

TABLE 2

Figure 2:
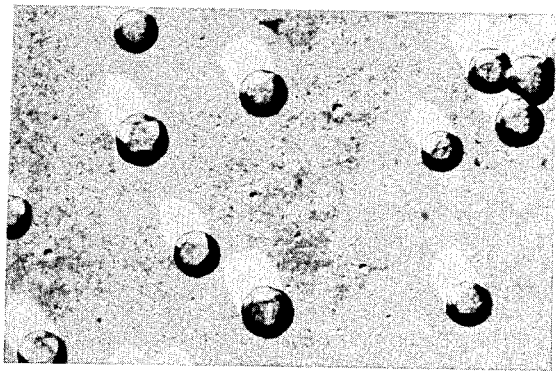

| Emulsion | Compound of the Invention No. | Compound of the Invention Amount (g) | Form of the Silver Halide Obtained |
|---|---|---|---|
| A | — | — | Cubic grains |
| I | 11 | 0.5 | Octahedral grains (FIG. 2) |
| J | 24 | 0.5 | Octahedral grains and tetradecahedral grains |

EXAMPLE 3

A cubic emulsion (Emulsion K) was obtained in the same way as in Example 1 except that the temperature of Solution (1) in the preparation of Emulsion A in Example 1 was maintained at 75° C. On obtaining the average volume of the volume load using the Coulter Counter method the value for Emulsion B (average grain diameter/grain thickness ratio about 5.2) was 0.24 $\mu m^3$, and the value for Emulsion K was 0.25 $\mu m^3$. After water washing and desalting using the normal flocculation method and adding gelatin, the pH at 40° C. was adjusted to 6.4 and the pAg value was adjusted to 7.5. Both emulsions were optimally sensitized using diphenylthiourea and Samples 1 and 2 described below were prepared.

The additives shown below were added and the emulsion and protective layers were coated onto an undercoated triacetyl cellulose film support.

Additives (1) Emulsion Layer

Emulsion: The emulsion shown in Table 3
Coupler:

-continued

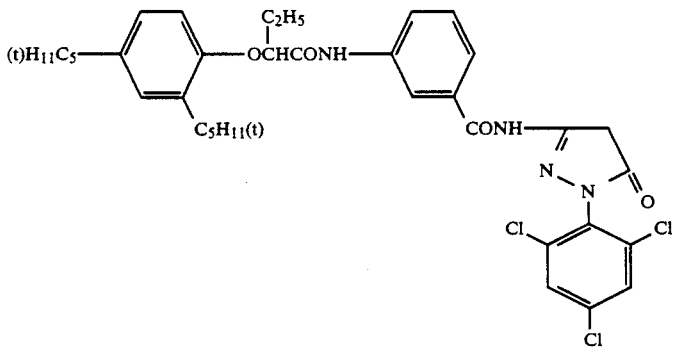

Stabilizer: 4-Hydroxy-6-methyl-1,3,3a,7-tetraazaindene
Coating aid: Sodium dodecylbenzenesulfonate
Tricresyl phosphate
Gelatin (2) Protective Layer 2,4-Dichloro-6-hydroxy-1,3,5-triazine sodium salt
Gelatin These samples were exposed through an optical wedge so that the exposure amount became 100 CMS per sec. of exposure time and then they were processed in the following way:

(1) Fuji Photo Film Co., Ltd., CN-16 Process
(2) Fuji Photo Film Co., Ltd., CP-20 Process
(3) Eastman Kodak Co., Ltd., D-76 Process Density measurements were carried out with the processed samples (the measurements were made with a green filter when color development had been carried out) and the photographic performance obtained was as shown in Table 3.

TABLE 3

| Developing Solution | Development Temperature (°C.) | Development Time | Relative Sensitivity (fog) Sample 1 (Invention) Emulsion B | Sample 2 (Comparison) Emulsion K |
|---|---|---|---|---|
| Process CN-16 | 38 | 30 sec | 80 | 25 |
| | | 1 min 15 sec | 91 | 57 |
| | | 3 min 15 sec | 100 (0.20) | 105 (0.25) |
| Process CP-20 | 33 | 30 sec | 40 | 14 |
| | | 1 min 15 sec | 72 | 52 |
| | | 3 min 30 sec | 100 (0.11) | 100 (0.12) |
| Process D-76 | 20 | 3 min 30 sec | 100 | 60 |
| | | 7 min | 100 (0.06) | 86 (0.06) |

It is clear from Table 3 that the development of the tabular silver chloride emulsion of this invention (Emulsion B) proceeded more quickly than that of the cubic emulsion (Emulsion K) and, moreover, there was another desirable feature in that there was less fogging. Hence, the emulsion of this invention is clearly preferred for rapid processing purposes.

The relative sensitivities shown in Table 3 indicate the relative values of the reciprocals of the exposures required to provide an optical density of fog value +0.2, taking that at 3 min 15 sec in the case of Sample 1 with the CN-16 Process, that at 3 min 30 sec in the case of Sample 1 with the CP-20 Process and that at 7 min in the case of Sample 1 with the D-76 Process, to be 100 in each case.

EXAMPLE 4

The average grain size of Emulsion A (cubic) in Example 1 was about 0.5 μm, and that of Emulsion C (octahedral grains and tabular grains) was about 0.6 μm.

These emulsions were washed with water and desalted in the same way as in Example 3 and, after adding gelatin, the pH and the pAg values were adjusted to 6.4 and 7.5, respectively, and the emulsions were then sensitized optimally with diphenylthiourea and chloroauric acid.

The same additives as used in Example 3 were then added, 1-phenyl-5-mercaptotetrazole was added as an antifogging agent, and the resulting emulsions were coated onto supports to provide Samples 3 and 4.

These samples were exposed through an optical wedge and then processed in accordance with the Fuji Photo Film Co., Ltd. CN-16 Process (color processing temperature 38° C) and the results shown in Table 4 were obtained.

The relative sensitivities in Table 4 indicate the relative values of the reciprocals of the exposures required to provide an optical density of fog value +1.0 and in each case the density at a development time of 3 min 15 sec was taken to be 100.

TABLE 4

| Development Time | Relative Sensitivity Sample 3 (Invention) | Sample 4 (Comparison) |
|---|---|---|
| 30 sec | 43 | 30 |
| 1 min 15 sec | 74 | 58 |
| 3 min 15 sec | 100 | 100 |

It is clear from Table 4 that the emulsion of this invention was preferred as an emulsion for rapid processing when compared to the cubic emulsion (Emulsion A).

EXAMPLE 5

After forming tabular silver chloride grains in the same way as for Emulsion B in Example 1, potassium bromide was added in an amount of $10^{-2}$ mol per mol of silver chloride and a layer consisting of silver bromide was formed locally in the vicinity of the surface of the grains. The emulsion was then optimally sensitized in the same way as in Example 3 to provide Emulsion L.

The following compounds were added respectively to Emulsions B, K and L.

Blue sensitizing dye (a)

Yellow coupler (b)

Colored image stabilizer (c)

(a) Blue Sensitizing Dye

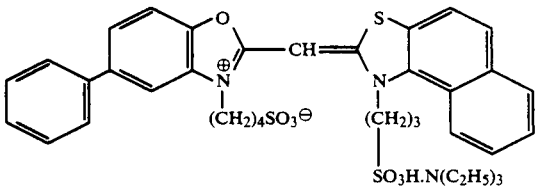

(b) Yellow Coupler

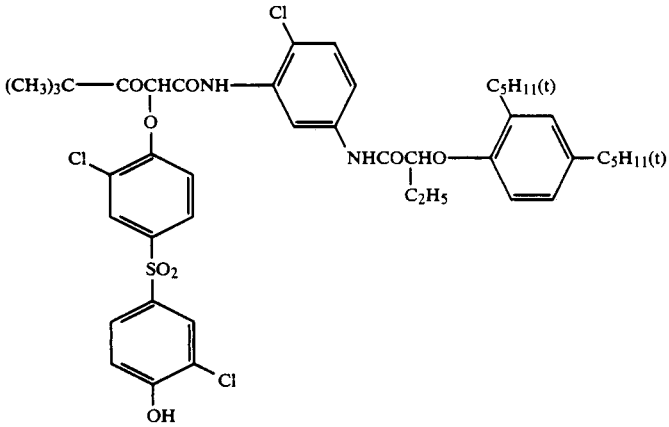

(c) Colored Image Stabilizer

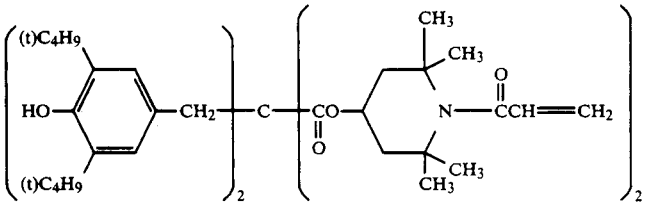

Moreover, the following compounds were added subsequently:

Stabilizer: 4-Hydroxy-6-methyl-1,3,3a,7-tetraazaindene

Antifogging Agent: 1-Phenyl-5-mercaptotetrazole

Film Hardeninu Agent: Sodium 2,4-dichloro-6-hydroxy-s-triazine

Coating Aid: Sodium dodecylbenzenesulfonate

The emulsions were then coated along with a gelatin protective layer onto paper supports which had been laminated on both sides with polyethylene to provide Samples 5, 6 and 7.

These samples were exposed under an optical wedge and processed in accordance with the processing operations indicated below, and the results obtained were as shown in Table 5.

The relative sensitivities indicate the relative values of the reciprocals of the exposures required to provide a density of fog value +0.5, that for Sample 7 on developing for 3 min 30 sec being taken to be 100.

It is clear from Table 5 that Emulsions B and L prepared using compounds of this invention had a higher speed than Comparative Emulsion K, and it is also clear that development proceeded more quickly and that these emulsions were suitable for rapid processing.

| Color Developing Solution (development at 33° C.) | | |
|---|---|---|
| Water | 800 | cc |
| Ethylenetriaminepentaacetic Acid | 1.0 | g |
| Sodium Sulfite | 0.2 | g |
| N,N-Diethylhydroxylamine | 4.2 | g |
| Potassium Bromide | 0.01 | g |
| Sodium Chloride | 1.5 | g |
| Triethanolamine | 8.0 | g |
| Potassium Carbonate | 30 | g |
| N-Ethyl-N-(β-methanesulfonamidoethyl)-3-methyl-4-aminoaniline Sulfate | 4.5 | g |
| 4,4'-Diaminostilbene Based Fluorescent Whitener (Whitex 4, made by Sumitomo Chemical Co.) | 2.0 | g |
| Water to make | 1,000 | c |
| pH (adjusted with KOH) | 10.25 | |
| **Bleach-Fix Solution (35° C., 45 seconds)** | | |
| Ammonium Thiosulfate (54 wt %) | 150 | ml |
| $Na_2SO_3$ | 15 | g |
| $NH_4[Fe(III)(EDTA)]$ | 55 | g |
| EDTA.2Na | 4 | g |
| Glacial Acetic Acid | 8.61 | g |
| Water to make | 1,000 | ml |
| pH | 5.4 | |
| **Rinse Solution (35° C., 90 seconds)** | | |
| EDTA.2Na.$2H_2O$ | 0.4 | g |
| Water to make | 1,000 | ml |
| pH | 7.0 | |

TABLE 5

| Sample | Emulsion | Relative Sensitivity 30 sec | 1 min | 3 min 30 sec | Remarks |
|---|---|---|---|---|---|
| 5 | B | 45 | 105 | 120 | Invention |
| 6 | L | 95 | 200 | 250 | Invention |
| 7 | K | 15 | 65 | 100 | Comparison |

EXAMPLE 6

An emulsion obtained by chemically sensitizing Emulsion B prepared in Example 1 in the same way as in Example 3 was used to replace each emulsion in Sample 1 in Example 1 disclosed in JP-A-62-215272 (Sample 8).

Sample 1 in Example 1 disclosed in JP-A-62-215272 was used for comparison as Sample 9. These samples were subjected to gradation exposure for sensitometry using a sensitometer (FWH type, made by Fuji Photo Film Co., Ltd.; color temperature of the light source: 3,200° K) through a blue filter. The exposure was carried out so that the exposure amount became 250 CMS per 0.5 sec of exposure time.

The exposed light-sensitive materials were processed as follows.

| Processing Step | Temperature (°C.) | Time |
|---|---|---|
| Color Development | 36 | 30 sec |
| | | 1 min |
| | | 2 min |
| Bleach-Fixing | 36 | 1 min |
| Washing | 30 | 2 min |
| Drying | 70 | 1 min |

Each processing solution used was as follows.

| | |
|---|---|
| **Color Developing Solution:** | |
| Diethylenetriaminepentaacetic Acid | 2.0 g |
| Benzyl Alcohol | Shown in Table 6 |
| Sodium Sulfite | 2.0 g |
| Potassium Carbonate | Shown in Table 6 |
| N-Ethyl-N-(β-methanesulfonamidoethyl)-3-methyl-4-aminoaniline Sulfate | 4.5 g |
| Hydroxylamine Sulfate | 4.0 g |
| Fluorescent Brightening Agent (stilbene type) | 1.0 g |
| Water to make | 1,000 ml |
| pH | 10.25 |
| **Bleach-Fixing Solution:** | |
| Ammonium Thiosulfate (70 wt/vol %) | 150 ml |
| Sodium Sulfite | 18 g |
| $NH_4$[Fe(III)(EDTA)] | 55 g |
| EDTA | 5 g |
| Water to make | 1,000 ml |
| pH | 6.75 |

TABLE 6

| | Process A | Process B |
|---|---|---|
| Benzyl Alcohol | 12.0 ml | — |
| Potassium Carbonate | 15.0 ml | 40 g |

After processing these samples, the measurement for development progress properties was conducted as relative sensitivity.

The relative sensitivity indicates the relative values of the reciprocals of the exposures required to provide a density of a minimum density plus 0.5, taking that at 3 min 15 sec in the cases of each sample with Process A to be 100 in each case.

The results are shown in Table 7.

TABLE 7

| Processing Solution | Development Time | Relative Sensitivity Sample 8 (Invention) | Sample 9 (Comparison) |
|---|---|---|---|
| A | 30 sec | 62 | 37 |
| | 1 min 15 sec | 83 | 66 |
| | 3 min 15 sec | 100 | 100 |
| B | 30 sec | 58 | 34 |
| | 1 min 15 sec | 79 | 63 |
| | 3 min 15 sec | 97 | 92 |

It is clear from Table 7 that Sample 8 of the present invention shows good development progress properties as compared to Sample 9 for comparison.

EXAMPLE 7

Emulsion B prepared in Example 1 was optimally sensitized using hypo and chloroaurate and then a sample was prepared using this emulsion in place of the emulsion in sample (101) in the examples described in JP-A-62-954 (Sample 10).

Further, Sample (101) in the examples described in JP-A-62-954 was used for comparison as Sample 11.

These samples were subjected to $10^{-3}$ sec gradation exposure through an optical wedge and a blue filter using a light-sensitive system of EG & G Co., and then development processed at 38° C. in accordance with the following processing steps.

| | |
|---|---|
| Color Development | 30 sec, 1 min 15 sec, 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 05 sec |

The processing solutions used in each processing step be as follows.

| | |
|---|---|
| **Color Developing Solution:** | |
| Diethylenetriaminepentaacetic Acid | 1.0 g |
| 1-Hydroxyethylidene 1,1-Diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 l |
| pH | 10.0 |
| **Bleaching Solution:** | |
| $NH_4$[Fe(III)(EDTA)] | 100.0 g |
| EDTA.Disodium Salt | 10.0 g |
| Ammonium Bromide | 150.0 g |
| Ammonium Nitrate | 10.0 g |
| Water to make | 1.0 l |
| pH | 6.0 |
| **Fixing Solution:** | |
| EDTA.Sodium Salt | 1.0 g |
| Sodium Sulfite | 4.0 g |
| Ammonium Thiosulfate (70% solution) | 175.0 ml |
| Sodium Bisulfite | 4.6 g |
| Water to make | 1.0 l |
| pH | 6.6 |
| **Stabilizing Solution:** | |
| Formalin (40%) | 2.0 ml |
| Polyoxyethylene-p-monononylphenyl Ether | 0.3 g |

-continued

| | |
|---|---|
| (average degree of polymerization: 10) | |
| Water to make | 1.0 l |

The thus-processed samples were measured by relative sensitivity.

The relative sensitivity indicates that the relative values of the reciprocals of the exposures required to provide a density of a minimum density plus 0.2, taking that at 3 min 15 sec in the cases of each sample to be 100 in each case.

The results are shown in Table 8.

TABLE 8

| Developing Time | Relative Sensitivity | |
|---|---|---|
| | Sample 10 (Invention) | Sample 11 (Comparison) |
| 30 sec | 30 | 20 |
| 1 min 15 sec | 65 | 52 |
| 3 min 15 sec | 100 | 100 |

It is clear from Table 8 that Sample 10 of the present invention shows good development progress properties as compared to Sample 11 for comparison.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide photographic emulsion comprising the step of:

reacting a water-soluble silver salt and at least one water-soluble halide salt containing chloride in aqueous solution in the presence of at least one compound represented by formulae (I) or (II):

(I)

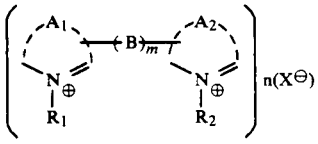

(II)

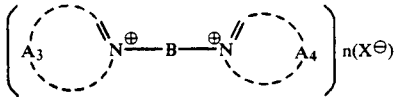

wherein $A_1$, $A_2$, $A_3$ and $A_4$, which may be the same or different, each represents a nonmetallic atomic group necessary for forming a substituted or unsubstituted heterocyclic ring which may be condensed with a benzene ring, said heterocyclic ring being selected from the group consisting of pyridine, imidazole, thiazole, oxazole, pyrazine and pyrimidine; B represents a divalent linking group; $R_1$ and $R_2$, which may be the same or different, each represents an alkyl group; X represents an anion necessary for charge balance; m is 0 or 1; and n is 0, 1, 2 or 3;

to form light-sensitive silver halid grains having a silver chloride content of at least 50 mol %, selected from octahedral grains, tetradecahedral grains and tabular grains, wherein at least 30% of the surface area of said light-sensitive silver halide grains is composed of (111) planes.

2. The method for producing a silver halide photographic emulsion as claimed in claim 1, wherein the substituted heterocyclic range formed from $A_1$, $A_2$, $A_3$ and $A_4$ is substituted with at least one substituent selected from the group consisting of an alkyl group, an aryl group, an aralkyl group, an alkenyl group, a halogen atom, an acyl group, an alkoxycarbonyl group, an aryloxcarbonyl group, a sulfo group, a carboxyl group, a hydroxyl group, an alkoxy group, an aryloxy group, an amido group, a sulfamoyl group, a carbamoyl group, a ureido group, an amino group, a sulfonyl group, a cyano group, a nitro group, a mercapto group, an alkylthio group and an arylthio group.

3. The method for producing a silver halide photographic emulsion as claimed in claim 2, wherein said heterocyclic ring formed by $A_1$, $A_2$, $A_3$ and $A_4$ is a substituted or unsubstituted pyridine ring.

4. The method for producing a silver halide photographic emulsion as claimed in claim 1, wherein said divalent linking group represented by B is selected from an alkylene group, an arylene group, an alkenylene group, $—SO_2—$, —SO—, —O—, —S—

$$-\underset{\underset{O}{\|}}{C}-,\quad -\underset{\underset{R_3}{|}}{N}-,$$

and a combination thereof, wherein $R_3$ represents an alkyl group, an aryl group or a hydrogen atom.

5. The method for producing a silver halide photographic emulsion as claimed in claim 4, wherein B represents an alkylene group or an alkenylene group.

6. The method for producing a silver halide photographic emulsion as claimed in claim 1, wherein $R_1$ and $R_2$ each represents an alkyl group containing 1 to 20 carbon atoms, unsubstituted or substituted with a substituent selected from the group consisting of an alkyl group, an aryl group, an aralkyl group, an alkenyl group, a halogen atom, an acyl group, an alkoxycarbonyl group, an aryloxycarbonyl group, a sulfo group, a carboxyl group, a hydroxyl group, an alkoxy group, an aryloxy group, an amido group, a sulfamoyl group, a carbamoyl group, a ureido group, an amino group, a sulfonyl group, a cyano group, a nitro group, a mercapto group, an alkylthio group and an arylthio group.

7. The method for producing a silver halide photographic emulsion as claimed in claim 6, wherein $R_1$ and $R_2$ each represents an alkyl group substituted with a substituted or unsubstituted aryl group.

8. The method for producing a silver halide photographic emulsion as claimed in claim 1, wherein said compound represented by formulae (I) or (II) is present in an amount of from $2\times10^{-5}$ to $3\times10^{-1}$ mol of silver halide contained in said emulsion.

9. The method for producing a silver halide photographic emulsion as claimed in claim 8, wherein said compound represented by formulae (I) or (II) is present in an amount of from $2\times10^{-4}$ to $1\times10^{-1}$ mol of silver halide contained in said emulsion.

10. The method for producing a silver halide photographic emulsion as claimed in claim 1, wherein said aqueous solution contains 0.05 to 5 mol/liter of chloride at the time of forming the nuclei of said silver halide grains, and during the growth of said silver halide grains the concentration of chloride is at most 5 mol/liter; said light-sensitive sil halide grains being tabular grains.

11. The method for producing a silver halide photographic emulsion as claimed in claim 10, wherein the concentration of chloride during the formation of said nuclei is 0.07 to 2 mol/liter, and during the growth of said silver halide grains the concentration of chloride is 0.1 to 2 mol/liter.

12. The method for producing a silver halide photographic emulsion as claimed in claim 11, wherein the concentration of chloride during the formation of said nuclei is 0.15 to 0.5 mol/liter.

13. The method for producing a silver halide photographic emulsion as claimed in claim 1, wherein said aqueous solution contains at most 0.5 mol/liter of chloride at the time of forming the nuclei of said silver halide grians, and during the growth of said silver halide grains the concentration of chloride is at most 5 mol/-liter; said light-sensitive silver halide grains being octahedral or tetradecahedral grains.

14. The method for producing a silver halide photographic emulsion as claimed in claim 13, wherein the concentration of chloride during the formation of said nuclei is 0.02 to 0.2 mol/liter and the concentration of chloride during the growth of said silver halide grains is from 0.07 to 2.0 mol/liter.

15. The method for producing a silver halide photographic emulsion as claimed in claim 14, wherein the concentration of chloride during the formation of said nuclei is 0.05 to 0.1 mol/liter.

16. The method for producing a silver halide photographic emulsion as claimed in claim 1, wherein the pH of said aqueous solution is from 2 to 8.

17. The method for producing a silver halide photographic emulsion as claimed in claim 16, wherein said light-sensitive silver halide grains have a silver chloride content of at least 70 mol %.

18. The method for producing a silver halide photographic emulsion as claimed in claim 16, wherein said light-sensitive silver halide grains have a silver chloride content of at least 90 mol %.

* * * * *